US011014798B2

(12) United States Patent
Nishino et al.

(10) Patent No.: US 11,014,798 B2
(45) Date of Patent: May 25, 2021

(54) FILLING SYSTEM

(71) Applicant: SHIBUYA CORPORATION, Ishikawa (JP)

(72) Inventors: Yukinobu Nishino, Ishikawa (JP); Katsunori Tanikawa, Ishikawa (JP); Koji Kaya, Ishikawa (JP); Kengo Ikeda, Ishikawa (JP); Shigeki Koishi, Ishikawa (JP); Masaaki Eda, Ishikawa (JP)

(73) Assignee: SHIBUYA CORPORATION, Ishikawa (JP)

( * ) Notice: Subject to any disclaimer, the term of this patent is extended or adjusted under 35 U.S.C. 154(b) by 1 day.

(21) Appl. No.: 16/332,956

(22) PCT Filed: Sep. 13, 2017

(86) PCT No.: PCT/JP2017/033152

§ 371 (c)(1),
(2) Date: Mar. 13, 2019

(87) PCT Pub. No.: WO2018/052047

PCT Pub. Date: Mar. 22, 2018

(65) Prior Publication Data

US 2019/0248638 A1 Aug. 15, 2019

(30) Foreign Application Priority Data

Sep. 14, 2016 (JP) ..... JP2016-179523

(51) Int. Cl.
*B67C 3/00* (2006.01)
*B65B 3/04* (2006.01)
(Continued)

(52) U.S. Cl.
CPC ..... *B67C 3/007* (2013.01); *B65B 3/04* (2013.01); *B67C 3/00* (2013.01); *B67C 3/02* (2013.01); *B67C 7/00* (2013.01)

(58) Field of Classification Search
CPC .. B67C 3/007; B67C 3/00; B67C 3/02; B67C 7/00; B65B 3/04
(Continued)

(56) References Cited

U.S. PATENT DOCUMENTS

2012/0085071 A1 4/2012 Hahn et al.
2013/0146421 A1 6/2013 Zoni

FOREIGN PATENT DOCUMENTS

JP 54-114279 U1 1/1953
JP H05-51087 3/1993
(Continued)

OTHER PUBLICATIONS

JP2014213877—Translated into English (Year: 2013).*
(Continued)

*Primary Examiner* — Timothy P. Kelly
*Assistant Examiner* — Christopher M Afful
(74) *Attorney, Agent, or Firm* — Greenblum & Bernstein, P.L.C.

(57) ABSTRACT

A filling system includes a center wheel that conveys vessels, a first filler provided with a plurality of filling heads, a second filler provided with a plurality of filling heads and arranged downstream from the first filler, a first inlet wheel that receives the vessels from the center wheel and supplies the vessels to the first filler, and a second inlet wheel that receives the vessel from the center wheel and supplies the vessels to the second filler. Operation modes are switchable between a first operation mode that conveys the vessels to the first filler and a second operation mode that conveys the vessels to the second filler instead of conveying to the first filler by controlling the reception of the vessels at the first and second inlet wheels.

4 Claims, 6 Drawing Sheets

(51) Int. Cl.
*B67C 7/00* (2006.01)
*B67C 3/02* (2006.01)

(58) Field of Classification Search
USPC ..... 141/144
See application file for complete search history.

(56) References Cited

FOREIGN PATENT DOCUMENTS

| | | | | |
|---|---|---|---|---|
| JP | 2003-237936 | A | | 8/2003 |
| JP | 2009-184686 | A | | 8/2009 |
| JP | 2010-70200 | A | | 4/2010 |
| JP | 2014-213877 | A | | 11/2014 |
| JP | 2014213877 | A | * | 11/2014 |
| WO | 2013/094587 | A1 | | 6/2013 |

OTHER PUBLICATIONS

Office Action issued in CHINA Counterpart Patent Appl. No. 201780051164.9, dated Mar. 3, 2021 (English Translation) (Year: 2021).*
International Search Report issued in PCT/JP2017/033152, dated Dec. 12, 2017.
Written Opinion issued in PCT/JP2017/033152, dated Dec. 12, 2017.
Official Communication issued in European Patent Office (EPO) Patent Application No. 1785094805, dated Nov. 20, 2019.

* cited by examiner

FILLING SYSTEM

TECHNICAL FIELD

The present invention relates to a filling system having a plurality of filling machines which can perform cleaning work on an unused filling machine while performing a filling operation with the other filling machines.

BACKGROUND ART

For example, there is known a filling system including first and second filling machines; in the first operation mode, the first and second filling machines fill different liquids into a vessel in turn; and in the second operation mode, only the second filling machine is used to fill only one type of liquid into the vessel while the unused first filling machine is washed (refer to Patent Document 1).

This filling system includes a bypass wheel for directly transporting a vessel to the second filling machine by skipping the first filling machine in the second operation mode. A rinser outlet wheel, which ejects vessels from a rinser provided upstream of the first filling machine and the bypass wheel, transfers vessels to a first conveyance wheel in the first operation mode and to the bypass wheel in the second operation mode.

Furthermore, in order to enable cleaning of the first filling machine in the second operation mode, a section provided with the first filling machine needs to be isolated from a section provided with the bypass wheel. Therefore, as for the structure disclosed in Patent Document 1, vessels are supplied to the first filling machine via the first conveyance wheel and a first inlet wheel, but are ejected from the first filling machine via a first outlet wheel and a second conveyance wheel. Further, a partition wall is provided between the first conveyance wheel and the first inlet wheel and between the first outlet wheel and the second conveyance wheel, whereby vessels are transferred through each of the opening provided with a shutter.

PRIOR ART DOCUMENT

Patent Document

Patent Document 1:
Japanese Unexamined Patent Publication No. 2014-213877

SUMMARY OF THE INVENTION

Problem to be Solved by the Invention

However, the configuration disclosed in Patent Document 1 requires the number of conveyance wheels to increase, thereby increasing the complexity of the configuration of a vessel retaining means. As a result, more space is required and the initial cost and ongoing maintenance costs increase.

An object of the present invention is to provide a simply configured filling system that can clean an unused filling machine while performing a filling operation with another (other) filling machine(s).

Means for Solving the Problems

A filling system of the present invention comprises a conveyance wheel that conveys vessels; a first filling machine that is provided with a plurality of filling means on a rotor; a second filling machine that is provided with a plurality of filling means on a rotor and arranged downstream of the conveyance wheel relative to the first filling machine; a first inlet wheel that receives the vessels from the conveyance wheel and supplies the vessels to the first filling machine; a second inlet wheel that receives the vessels from the conveyance wheel and supplies the vessels to the second filling machine; a first chamber that houses the first filling machine; a second chamber that houses the second filling machine; a third chamber that houses the conveyance wheel; openings that are provided between the first chamber and the third chamber and between the second chamber and the third chamber and through which the vessels pass when transferred; and an opening/closing means that closes the openings; the first and second inlet wheels each comprise a holding means that receives the vessel from the conveyance wheel; and the filling system comprises a control means that controls the reception of the holding means and the control means can switch modes between a first operation mode that conveys the vessels to the first filling machine and a second operation mode that conveys the vessels to the second filling machine instead of the first filling machine by controlling the reception of the vessels at the holding means, which are provided on the first and second inlet wheels.

Effect of the Invention

According to the present invention, a simply configured filling system is provided that can clean an unused filling machine while performing a filling operation with another (other) filling machine(s).

EMBODIMENT OF THE INVENTION

Figure 1:
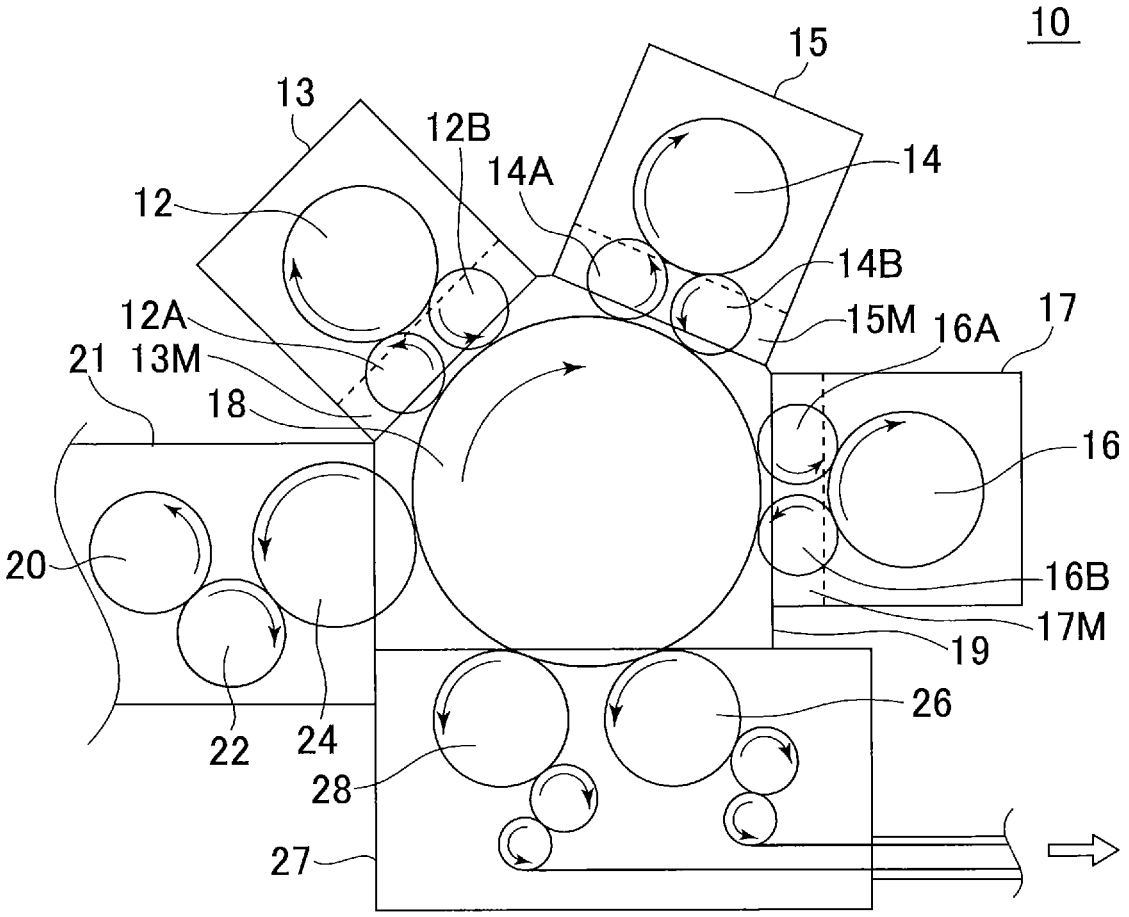
FIG. 1 is a plan view illustrating an arrangement of the filling system of the present embodiment.

Hereafter, embodiments of the present invention are described with reference to the accompanying drawings. FIG. 1 is a plan view of a filling system according to an embodiment of the present invention.

The filling system 10 of the present embodiment includes, for example, three filling machines such as a first to third filler 12, 14 and 16. The first to third filler 12, 14 and 16 are arranged around a center wheel (a conveyance wheel) 18, which conveys vessels. The first to third filler 12, 14 and 16 and the center wheel 18 are arranged inside an integrated chamber. The interior of the chamber is partitioned by walls and divided into a first to third filling chamber 13, 15 and 17 where the first to third filler 12, 14 and 16 are disposed, respectively, and a conveyance chamber 19 where the center wheel 18 is disposed.

Furthermore, in the present embodiment are rotary-type first to third inlet wheels 12A, 14A and 16A that receive empty vessels from the center wheel 18 and hand them over to the respective first to third fillers 12, 14 and 16 and rotary type first to third outlet wheels 12B, 14B and 16B that receive filled vessels from the respective first to third fillers 12, 14 and 16 and hand them over to the center wheel 18, all of which are provided, respectively, between the first to third fillers 12, 14, 16 and the center wheel 18. The areas between the first to third filling chambers 13, 15, 17 and conveyance chamber 19 are designated first to third intermediate zones (intermediate chambers) 13M, 15M and 17M, respectively. The first to third inlet wheels 12A, 14A, 16A and the first to third outlet wheels 12B, 14B, 16B are each arranged in the corresponding first to third intermediate zones 13M, 15M and 17M.

Namely, vessels can be supplied from the center wheel 18 to the first filler 12 via the first inlet wheel 12A and the vessels filled by the first filler 12 are returned to the center wheel 18 via the outlet wheel 12B. Likewise, vessels can be supplied from the center wheel 18 to the second and third fillers 14 and 16 via the respective inlet wheels 14A and 16A and the filled vessels are returned from the second and third fillers 14 and 16 to the center wheel 18 via the outlet wheels 14B and 16B.

In the present embodiment, the first, second and third fillers 12, 14 and 16 are arranged around the center wheel 18 in this order, which is also the upstream to downstream order with respect to the vessel conveyance direction. The first filler 12 may be a filler for a solid substance and the second filler 14 may be a weight filler (for non-carbonated beverage). Furthermore, the third filler 16 may be a gas filler (for carbonated and non-carbonated beverage). Empty vessels are supplied to the center wheel 18 from the upstream side of the first filler 12 via conveyance wheels 20, 22 and 24. The conveyance wheels 20, 22 and 24 are, for example, arranged inside a vessel sterilization chamber 21 and sterilized empty vessels are supplied from the vessel sterilization chamber 21 to the center wheel 18 inside a conveyance chamber 19.

In the filling system 10 of the present embodiment, either solid, liquid or gas content or a combination thereof is filled into a vessel by at least one of the first to third fillers 12, 14 and 16. The vessel, which was subjected to a filing operation at each filler, is handed over to the center wheel 18.

Further around the center wheel 18 on the downstream side of the third filler 16, a capper for capping a filled vessel may be arranged. In the present embodiment, for example, a plurality of cappers corresponding to caps having different calibers are arranged. An example shown in the figure is provided with two cappers: a first capper 26 and a second capper 28. The first and the second capper 26 and 28 are, for example, provided inside a capper chamber 27. The vessels that have been filled in the filling system 10 are delivered to either of the first or the second capper 26, 28 and further transported to a downstream processing system after capping is completed.

Next, with reference to FIG. 2, the relationship between the first to third filling chambers 13, 15, 17; the first to third intermediate zones 13M, 15M, 17M; the conveyance chamber 19; the first to third fillers 12, 14, 16; the inlet wheels 12A, 14A, 16A; the outlet wheels 12B, 14B, 16B; and the center wheel 18 of the present embodiment will be explained in detail. Note that, since the configurations are common among the first to third filling chambers 13, 15 and 17, representative examples for each of the components will be explained below.

Figure 2:
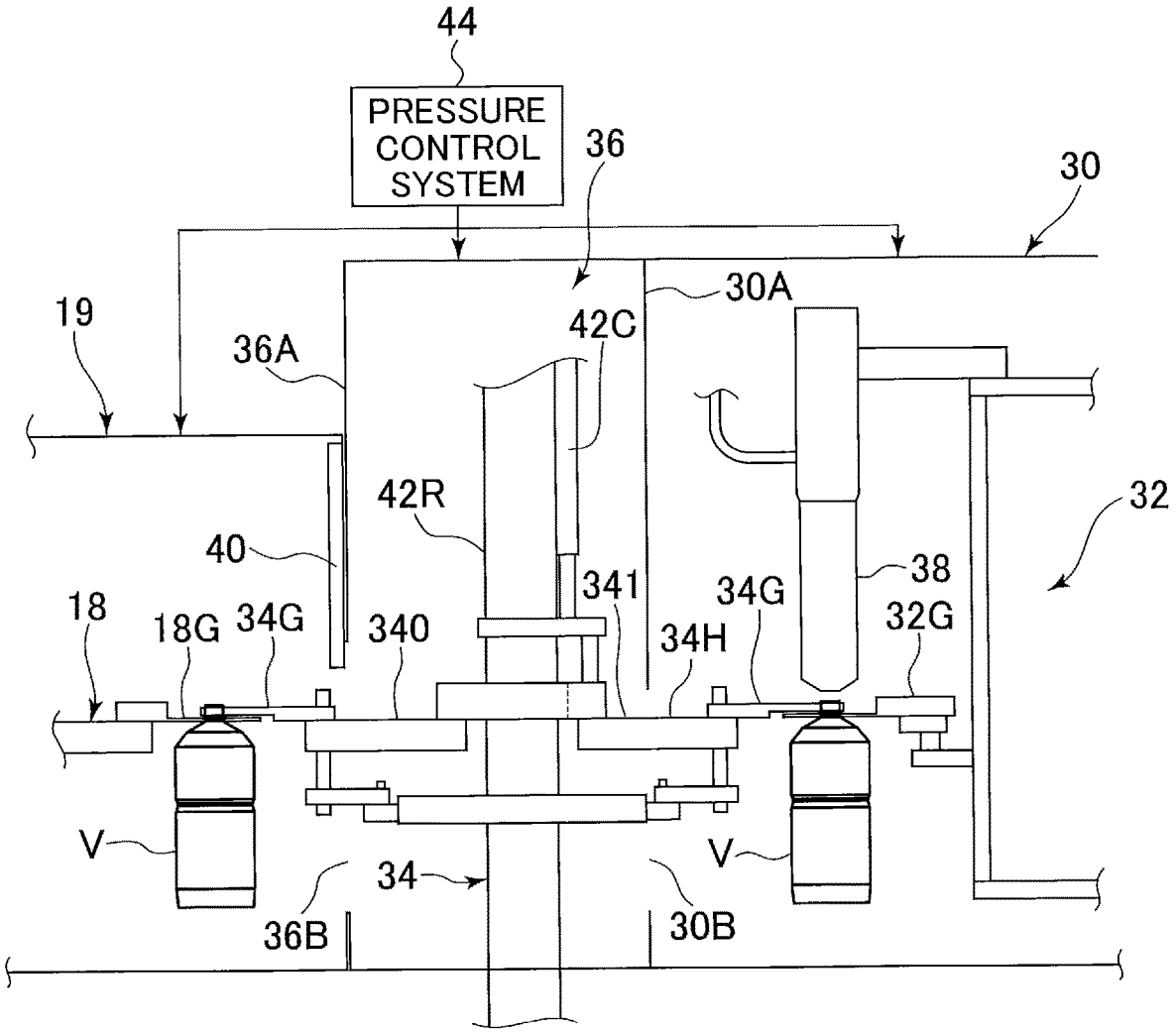
FIG. 2 is side sectional view illustrating the relationship between the filling chamber, the intermediate zone and the conveyance chamber.

FIG. 2 is a side sectional view showing the relationship between the conveyance chamber, intermediate zones (intermediate chambers) and filling chambers. In FIG. 2, the first to third filling chambers 13, 15 and 17 are represented by a filling chamber 30 and the first to third fillers 12, 14 and 16 are represented by a filler (filling machine) 32. Likewise, the inlet wheels 12A, 14A and 16A and outlet wheels 12B, 14B and 16B are represented by an inlet/outlet wheel 34, while the first to third intermediate zones (intermediate chambers) 13M, 15M and 17M are represented by an intermediate zone (intermediate chamber) 36.

As described in the figure, between the conveyance chamber 19 and the intermediate zone 36 is partitioned by a partition wall 36A and between the intermediate zone 36 and the filling chamber 30 is partitioned by a partition wall 30A. The center wheel 18 is arranged inside the conveyance chamber 19, the inlet/outlet wheel 34 inside the intermediate zone 36 and the filler 32 inside the filling chamber 30.

The center wheel 18, inlet/outlet wheel 34 and the filler 32, for example, perform neck-handle conveyance, while on the circumference of the wheel of each device multiple grippers for holding a lip or a neck of a vessel V are provided along the periphery. For example, the center wheel 18 is provided with grippers 18G and the inlet/outlet wheel 34 is provided with grippers (vessel grasping means/vessel holding means) 34G. Likewise, the filler 32 is provided with grippers 32G.

An opening 30B is provided in the partition wall 30A, which separates the space between the intermediate zone 36 and the filling chamber 30. The grippers 34G of the inlet/outlet wheel 34 installed inside the intermediate zone 36 extend outward from inside the filling chamber 30 through the opening 30B with a rotating wheel 34H supporting the grippers 34G. Namely, the grippers 34G of the inlet/outlet wheel 34 hand over the vessels V to the grippers 32G of the filler 32 inside the filling chamber 30. Note that, the size and the shape of the opening 30B are preferably as small as possible unless it obstructs the passage of the grippers 34G, the rotary wheel 34H and the vessels V between the intermediate zone 36 and the filling chamber 30.

Inside the filling chamber 30, above the grippers 32G of the filler 32, filling heads (filling means) 38 are respectively provided along the periphery of the wheel of the filler 32 at positions corresponding to each of the grippers 32G. While the wheel is being rotated, predetermined content is supplied from the filling heads 38 to the empty vessels V, which are held by the grippers 32G.

Furthermore, an opening 36B is provided in the partition wall 36A, which separates between the intermediate zone 36 and the conveyance chamber 19. The grippers 34G of the inlet/outlet wheel 34 extend outward from inside the conveyance chamber 19 through the opening 36B with the rotating wheel 34H supporting the grippers 34G. Namely, the grippers 34G of the inlet/outlet wheel 34 hand over the vessels V to the grippers 18G of the center wheel 18 inside the conveyance chamber 19. Note that, the opening 36B has a rectangular shape and its size is determined so that it does not obstruct the passage of the grippers 34G, the rotary wheel 34H and the vessels V between the intermediate zone 36 and the conveyance chamber 19.

Near the opening 36B, a shutter (opening/closing door, opening/closing means) 40 is provided that can close the opening 36B. The shutter 40, for example, is driven by a rack and pinion mechanism, as explained later, and the mechanism is driven by a motor 40M provided outside the chamber.

Further, in order to close the opening 36B with the shutter 40, the rotary wheel 34H of the inlet/outlet wheel 34, which extends out through the opening 36B, and the grippers 34G attached thereto should be removed from the opening 36B.

In the present embodiment, as described later, a movable section 341 corresponding to a part of the arcuate section of the rotary wheel 34H together with the grippers 34G attached thereto can be raised and lowered either above or below the vertical position of a fixed section 340 configuring an arcuate section of the rotary wheel 34H not part of the movable section 341. Inside the intermediate zone 36, the movable section 341 is shifted relatively higher or lower than the fixed section 340 to be rotatable about the rotational axis of the rotary wheel 34H, thereby making the movable section 341 rotationally movable to a retracted position located above or below the fixed section 340.

In the present embodiment, the movable section 341 is raised or lowered by a lift cylinder 42C provided on the inlet/outlet wheel 34 and rotated about the rotational axis of the inlet/outlet wheel 34 via a rotary mechanism 42R. Note that, in FIG. 2, an example in which the movable section 341 is lifted upward with respect to the fixed section 340 is illustrated.

When the opening 36B is closed by shutter 40, the movable section 341 is moved to the retracted position and then the rotary wheel 34H is rotated so that the portion where the retracted movable section 341 was disposed before the retraction is positioned at the opening 36B. Thereby, the rotary wheel 34H is retracted from the opening 36B so that the shutter 40, which closes the opening 36B, and the rotary wheel 34H do not interfere with one another.

Furthermore, the filling system 10 includes a pressure control system (pressure control means) 44. The pressure control system 44 controls the air supply whereby the pressure increases in order from the conveyance chamber 19 to the intermediate zone 36 to the filling chamber 30 (air pressure in conveyance chamber 19<intermediate zone 36<filling chamber 30) when the filler 32 is in operation, in other words, when the vessels are transferred among the center wheel 18, the inlet/outlet wheel 34 and the filler 32. On the other hand, when other fillers instead of the filler 32 are in operation and when the filler 32 is being washed (a second operation mode), i.e., when the movable section 341 is moved to the retracted position and the opening is closed by the shutter 40, the air supply for each of the sections 36, 30 and 19 is controlled so that the pressure increases in order from the intermediate zone 36 to the filling chamber 30 to the conveyance chamber 19 (air pressure in intermediate zone 36<filling chamber 30<conveyance chamber 19).

Figure 3A:
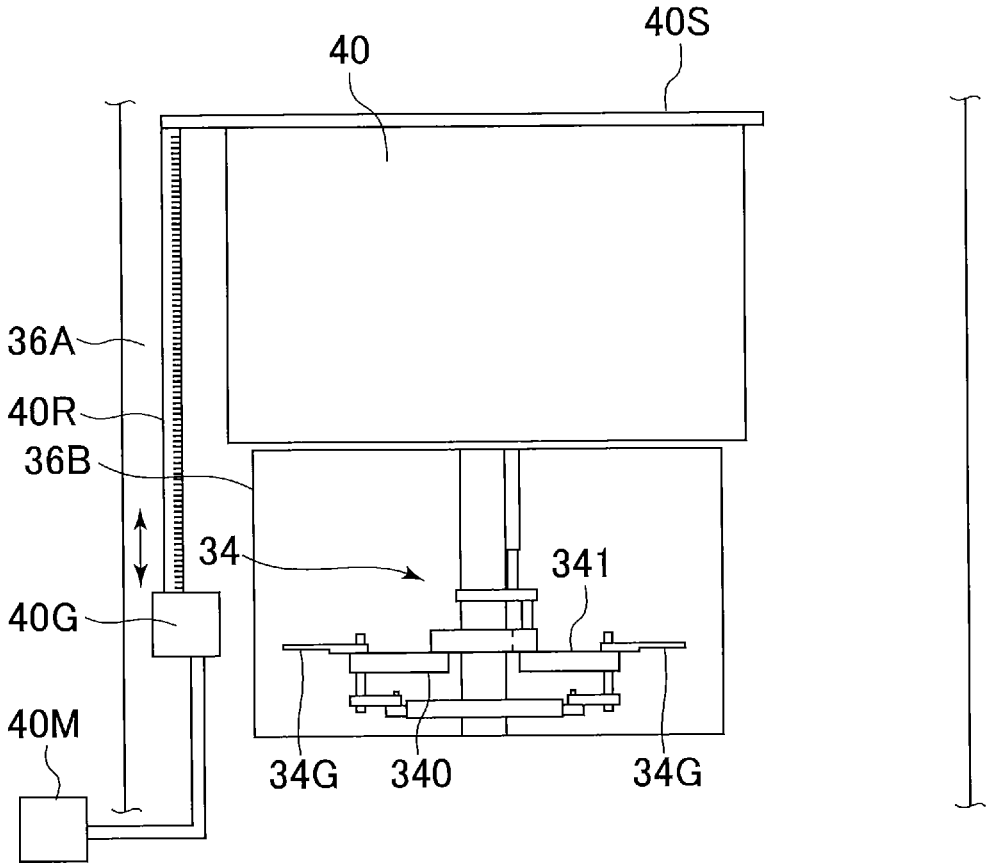
FIG. 3A illustrates the intermediate zone provided with the inlet/outlet wheel from the point of view of the conveyance chamber as seen through the opening.
Figure 3B:
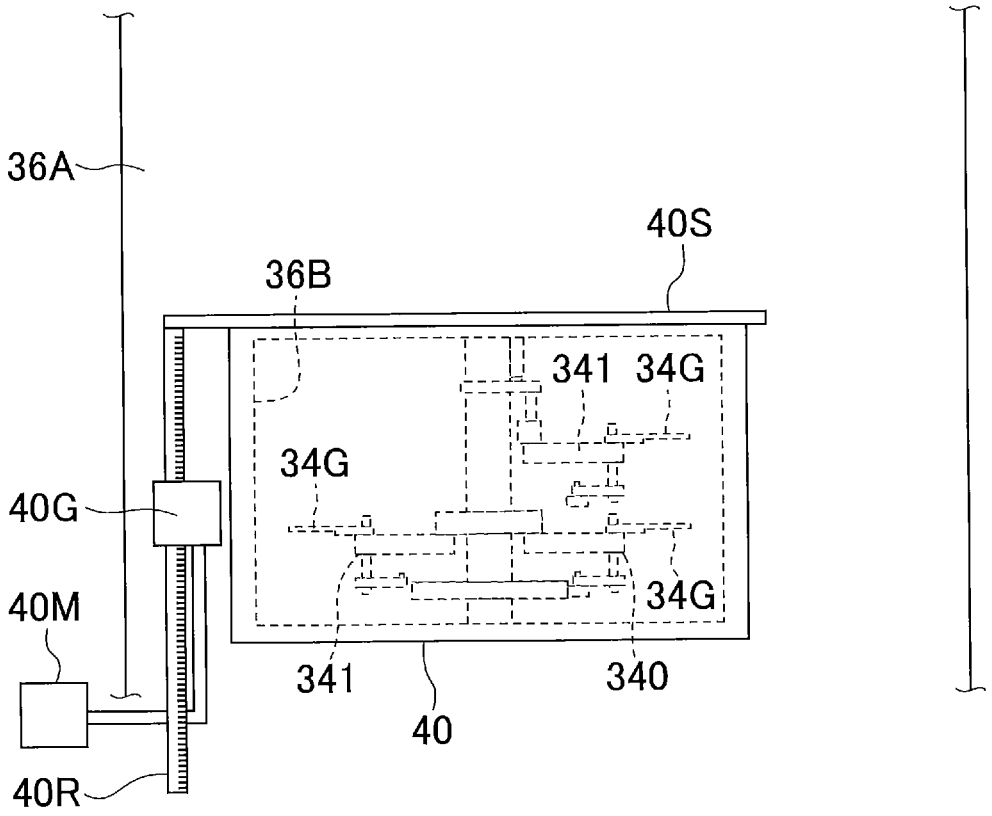
FIG. 3B also illustrates the intermediate zone provided with the inlet/outlet wheel from the point of view of the conveyance chamber as seen through the opening.

FIGS. 3A and 3B illustrate the intermediate zone 36, where the inlet/outlet wheel 34 is installed, from the point of view of the conveyance chamber 19 through the opening 36B. FIG. 3A illustrates a state of the first operation mode, in which the shutter 40 is opened, the movable section 341 forms part of the rotary wheel 34H at the position before the retraction is performed, and the vessels are transferred between the grippers 34 and the center wheel 18. FIG. 3B illustrates a state of the second operation mode, in other words when the movable section 341 is moved to the retracted position, the grippers 34G are not in operation (the vessels are not received from the center wheel 18) and the shutter 40 is closed. Note that, switching between the first operation mode and the second operation mode in the filling system 10 is controlled by a controller that is not shown.

As described in FIGS. 3A and 3B, the upper side of the shutter 40 is, for example, held by the support member 40S, which is supported by a rack 40R. The rack 40R engages with a pinion driven by a motor 40M, inside a gearbox 40G, so that it is raised and lowered by the rotation of the motor 40M. Thereby, the shutter 40 can be raised and lowered to open and close the opening 36B.

Figure 4A:
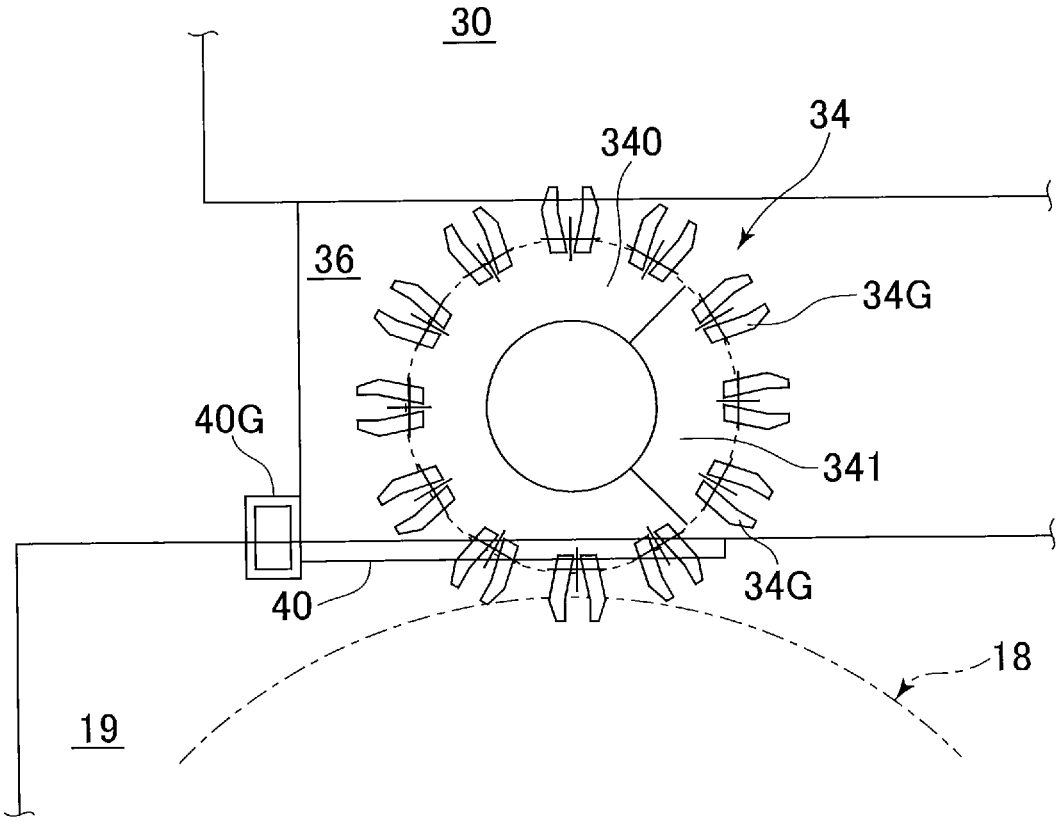
FIG. 4A is a plan view illustrating an arrangement of the filling chamber, the intermediate zone and the inlet/outlet wheel inside the conveyance chamber.
Figure 4B:
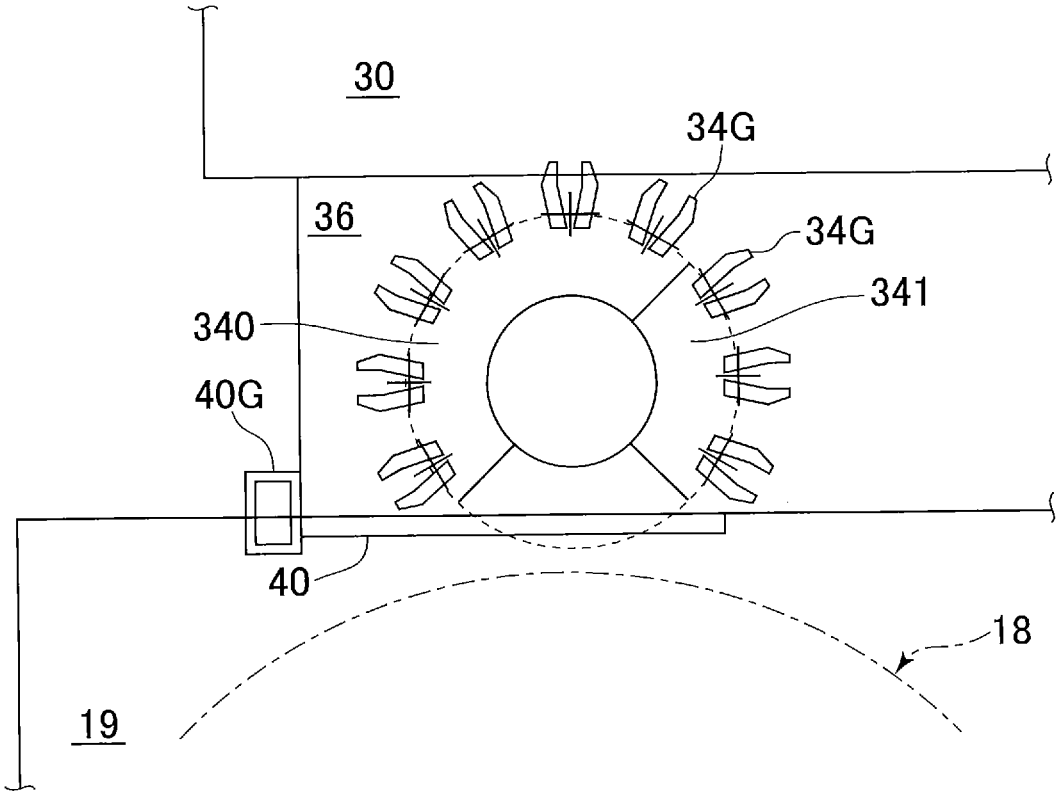
FIG. 4B is a plan view illustrating an arrangement of the filling chamber, the intermediate zone and the inlet/outlet wheel inside the conveyance chamber.

FIGS. 4A and 4B are plan views illustrating an arrangement of the filling chamber 30, the intermediate zone and the inlet/outlet wheel 34 inside the conveyance chamber 19. FIG. 4A illustrates when the system is operated in the first operation mode in which the filler 32 of the filling chamber 30 is used. FIG. 4B illustrates when the system is operated in the second operation mode, in which the filler 32 of the filling chamber 30 is inactive and the center wheel 18 and the other fillers are active while the movable section 341 of the inlet/outlet wheel 34 is retracted, the shutter 40 is closed, and further, the filler 32 is being washed.

As illustrated in FIG. 4A, the movable section 341 together with the fixed section 340 forms the circular rotary wheel 34H of the inlet/outlet wheel 34, when the filler 32 is being used, a part of the rotary wheel 34H extends out to the conveyance chamber 19 through the opening 36B, and the gripper 34G provided on the periphery of the rotary wheel 34H protrudes out to a position where it can hand over a vessel to the gripper of the conveyance wheel 18 in the conveyance chamber 19. Note that, in this state, the rotations of the conveyance wheel 18, the inlet/outlet wheel 34 and the filler 32 are obviously synchronized to enable the hand over between each of the grippers.

In the conditions of FIG. 4B, the operation of the filler 32 and the inlet/outlet wheel 34 is suspended and the conveyance wheel 18 conveys vessels to inlet/outlet wheels of the other fillers. As illustrated in FIG. 4B, the movable section 341 is moved to the retracted position, which overlaps above the fixed section 340, an arcuate portion of the rotary wheel 34, in which the movable section 341 is displaced, faces the opening 36B and the shutter 40 is closed via the motor 40M drive.

In the above-mentioned configuration, the filling system 10 of the present embodiment is, for example, operated as described below. For example, a solid substance is filled into the vessel V from the first filler 12. When liquid is filled from the second filler 14, the first and second fillers 12 and 14 are operated and the first and second inlet wheels 12A, 14A and the first and second outlet wheels 12B, 14B are operated in the state shown in FIG. 3A and FIG. 4A with the shutter 40 opened. Note that, the third filler 16 is not driven in this situation.

On the other hand, when only the second filler 14 for filling liquid and the third filler 16 for filling gas are used and the first filler 12 for filling a solid substance is not used, the operation of the first filler 12, the first inlet wheel 12A and the first outlet wheel 12B is suspended. The movable sections 341 of the inlet wheel 12A and the outlet wheel 12B are moved to the retracted positions, and then, two openings 36B provided in the partition walls 36A of the first intermediate zone 13M corresponding to the first inlet wheel 12A and the first outlet wheel 12B are closed. Thereby, the filling chamber 13 provided with the first filler 12 and the first intermediate zone 13M are separated from the conveyance chamber 19 provided with the center wheel 18, so that the first filler 12 can be washed while the vessels are conveyed to the second and third fillers 14, 16 by the operation of the center wheel 18.

As described above, according to the present embodiment, the filling system capable of washing an unused filling machine while performing filling operations in other filling machines can be configured with a small number of conveyance wheels. Thereby, the filling system with the above-mentioned functions can be provided while saving space and reducing initial set-up and ongoing maintenance costs.

EXPLANATION OF REFERENCES

10 filling system
12 first filler
12A first inlet wheel
12B first outlet wheel
13 first filling chamber
13M first intermediate zone
14 second filler
14A second inlet wheel
14B second outlet wheel
15 second filling chamber
15M second intermediate zone
16 third filler
16A third inlet wheel
16B third outlet wheel
17 third filling chamber
17M third intermediate zone
18 center wheel (conveyance wheel)
18G gripper
19 conveyance chamber
30 filling chamber
32 filler
32G gripper
34 inlet/outlet wheel
34G gripper
34H rotary wheel
36 intermediate zone
36A partition wall
36B opening
40 shutter
42C lift cylinder
42R rotary mechanism
44 presser control system
340 fixed section
341 movable section
V vessel

The invention claimed is:

1. A filling system comprising:

a conveyance wheel that conveys vessels;

a first filling machine that is provided with a plurality of filling heads on a rotor;

a second filling machine that is provided with a plurality of filling heads on a rotor and arranged downstream of the conveyance wheel relative to the first filling machine;

a first inlet wheel that receives the vessels from the conveyance wheel and supplies the vessels to the first filling machine;

a second inlet wheel that receives the vessels from the conveyance wheel and supplies the vessels to the second filling machine;

a first chamber that houses the first filling machine; a second chamber that houses the second filling machine; a third chamber that houses the conveyance wheel;

openings that are provided between the first chamber and the third chamber and between the second chamber and the third chamber and through which the vessels pass when transferred; and a shutter for closing the openings;

the first and second inlet wheels each comprise grippers that receives the vessels from the conveyance wheel;

a first outlet wheel configured to receive the vessels from the first filling machine and to hand the vessels over to the conveyance wheel;

a second outlet wheel configured to receive the vessels from the second filling machine and to hand the vessels over to the conveyance wheel; and the filling system comprises a controller that controls the reception of the grippers; and the controller can switch modes between a first operation mode that conveys the vessels to the first filling machine via the first inlet wheel and hands the filled vessels over to the conveyance wheel via the first outlet wheel and a second operation mode in which the vessels are conveyed to the second filling machine, instead of the first filling machine, via the second inlet wheel by controlling the reception of the vessels at the grippers, which is provided on the first and second inlet wheels, and wherein the second filling machine hands the filled vessels over to the conveyance wheel via the second outlet wheel.

2. A filling system, comprising:

a conveyance wheel configured to convey vessels;

a first filling machine that is provided with a plurality of filling heads on a rotor;

a second filling machine that is provided with a plurality of filling heads on a rotor and arranged downstream of the conveyance wheel relative to the first filling machine;

a first chamber that houses the first filling machine;

a second chamber that houses the second filling machine;

a third chamber that houses the conveyance wheel;

a first opening provided between the first chamber and the third chamber, the first opening configured to allow the vessels to pass therethough when the vessels are transferred between the first filling machine and the conveyance wheel;

a second opening provided between the second chamber and the third chamber, the second opening configured to allow the vessels to pass therethough when the vessels are transferred between the second filling machine and the conveyance wheel;

a first inlet wheel having a first set of grippers that are configured to receive the vessels from the conveyance wheel and supply the vessels to the first filling machine;

a second inlet wheel having a second set of grippers that are configured to receive the vessels from the conveyance wheel and supply the vessels to the second filling machine;

a first outlet wheel configured to receive the vessels from the first filling machine and to hand the vessels over to the conveyance wheel;

a second outlet wheel configured to receive the vessels from the second filling machine and to hand the vessels over to the conveyance wheel;

a shutter configured to open and close the first opening;

a first operation mode in which the first opening is opened by the shutter and the vessels are transferred through the first opening and between the first set of grippers and the conveyance wheel; and a second operation mode in which the first opening is closed by the shutter, and the vessels are transferred through the second opening and between the second set of grippers and the conveyance wheel, the filling system comprises a controller that controls the reception of the first set of grippers and the second set of grippers; and the controller can switch modes between a first operation mode that conveys the vessels to the first filling machine via the first inlet wheel and hands the filled vessels over to the conveyance wheel via the first outlet wheel and a second operation mode in which the vessels are conveyed to the second filling machine, instead of the first filling machine, via the second inlet wheel by controlling the reception of the vessels at the first set of grippers and the second set of grippers, which are respectively provided on the first and second inlet wheels, and wherein the second filling machine hands the filled vessels over to the conveyance wheel via the second outlet wheel.

3. The filling system according to claim 1, wherein each of the first inlet wheel, second inlet wheel, first outlet wheel and second outlet wheel is configured to directly transfer vessels with the conveyance wheel.

4. The filling system according to claim 2, wherein each of the first inlet wheel, second inlet wheel, first outlet wheel and second outlet wheel is configured to directly transfer vessels with the conveyance wheel.

* * * * *